United States Patent [19]

Amdal

[11] 4,087,883

[45] May 9, 1978

[54] DOOR SUPPORT

[75] Inventor: Dagfinn O. Amdal, Rockford, Ill.

[73] Assignee: Keystone Consolidated Industries, Inc., Peoria, Ill.

[21] Appl. No.: 741,959

[22] Filed: Nov. 15, 1976

[51] Int. Cl.[2] ..... E05F 5/02

[52] U.S. Cl. ..... 16/82; 292/262; 292/338

[58] Field of Search ..... 16/82, 49; 292/262, 292/270, 275, 338; 108/77, 80, 82; 248/285, 286; 217/60 E; 312/280, 281, 282

[56] References Cited

U.S. PATENT DOCUMENTS

| | | | |
|---|---|---|---|
| 406,846 | 7/1889 | Jones | 292/275 |
| 1,221,751 | 4/1917 | Lane | 292/275 |

*Primary Examiner*—Dorsey Newton

*Attorney, Agent, or Firm*—Allegretti, Newitt, Witcoff & McAndrews

[57] ABSTRACT

A door support bracket includes a slide member telescopically inserted in a housing bracket member. The housing bracket member is attached to a horizontal hung door by means of a swivel bracket. The free end of the slide member is pivotally attached to the frame for the door. The housing bracket member is formed from an elastic material and cooperates with cam members on the slide member to hold the door in an open position.

8 Claims, 12 Drawing Figures

7.
32
54
54
34
52
28
48
36
38
80
78
58
56
62
60
76
74
72
70
30
7.

32
68
66
64

34
52
54
28
48
44
36
42
38
58A
58
62A
62
46
50
40
80
80A
78
74
78A
74B
74C
74A
30
70
72
82
84

DOOR SUPPORT

BACKGROUND OF THE INVENTION

This invention relates to a door support bracket construction and more particularly to a door bracket construction especially useful for supporting a horizontal hung door in an open position.

Recreational vehicles and the like often include cabinet storage space with horizontal hung doors. That is, the doors have hinges along the top edge and are attached to swing about a horizontal axis upwardly and outwardly from a mounting frame to permit access to the interior of a cabinet. It is desirable to have some sort of support for the horizontal hung door when in the open position.

In the past, various schemes have been attempted to provide an appropriate support to maintain a horizontal hung door in an open position. For example, a separate hook and eyelet may be attached to the door and engaged to hold the door in an open position. A rod may also be provided as a brace between the door and the frame whenever the door is moved to the open position.

While the prior art methods adequately support the door, improved support bracket constructions are desirable. Preferably, such a bracket construction should be economical to manufacture, light in weight, rugged in construction and easily installed in a recreational vehicle. Also, such a bracket should be fabricated from a non-corrosive material. Finally, the bracket construction should support the door in such a fashion that the door will not close from inertia which might result from jostling that occurs during movement of the recreational vehicle.

It is with this background that the subject matter of the present invention was conceived and made.

SUMMARY OF THE INVENTION

In a principal aspect, the present invention comprises a door support bracket especially adapted to maintain a horizontal hung door in an open position relative to its frame. The bracket construction includes a bracket member or bracket housing comprised of an elastic material. A slide member telescopically fits within the bracket housing and includes cam means which cooperate with cam surfaces of the housing to maintain the bracket in a full extended position. The door support force generated by the opposing cam means and cam surfaces may be mechanically or forcefully overcome to close the horizontal hung door. The force to overcome the cam support is dependent upon the elastic nature of the bracket member or bracket housing as well as the cam size and shape.

Thus, it is an object of the present invention to provide an improved door support bracket construction particularly useful for recreational vehicles, mobile homes and the like.

A further object of the present invention is to provide a door support bracket construction made of interfitting telescoping members wherein one end of each member is pivotally attached to the door and frame, respectively.

A further object of the present invention is to provide a door support bracket construction which may be fabricated from an elastic material at low cost.

Still a further object of the present invention is to provide a door support bracket construction which is economical to manufacture easy to use and which is not cumbersome.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Referring to the figures, FIGS. 1 through 4 illustrate the environment of the improved door bracket construction of the present invention. FIGS. 5 through 12 illustrate in greater detail the structure of the device.

Figure 1:
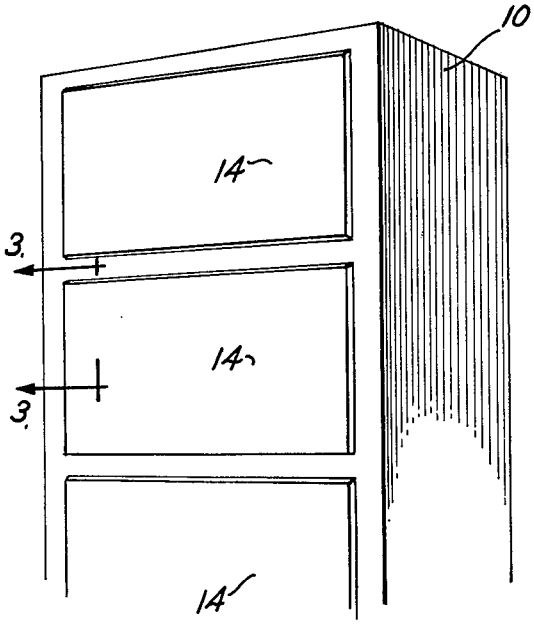
FIG. 1 is a perspective view of a typical cabinet having a plurality of horizontal hung doors attached thereto.
Figure 2:
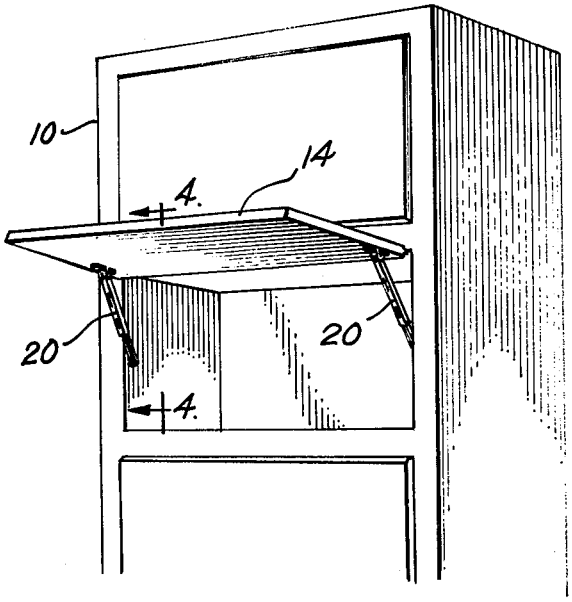
FIG. 2 is a perspective view of the cabinet of FIG. 1 wherein one of the doors has been moved to the open position, the door being supported by a bracket construction of the type described and claimed in the present application.
Figure 3:
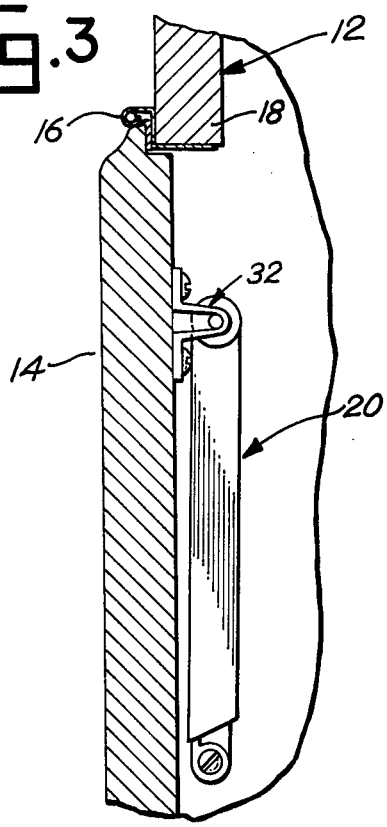
FIG. 3 is a cross-sectional view of the installed door taken along the line 3—3 in FIG. 1.
Figure 4:
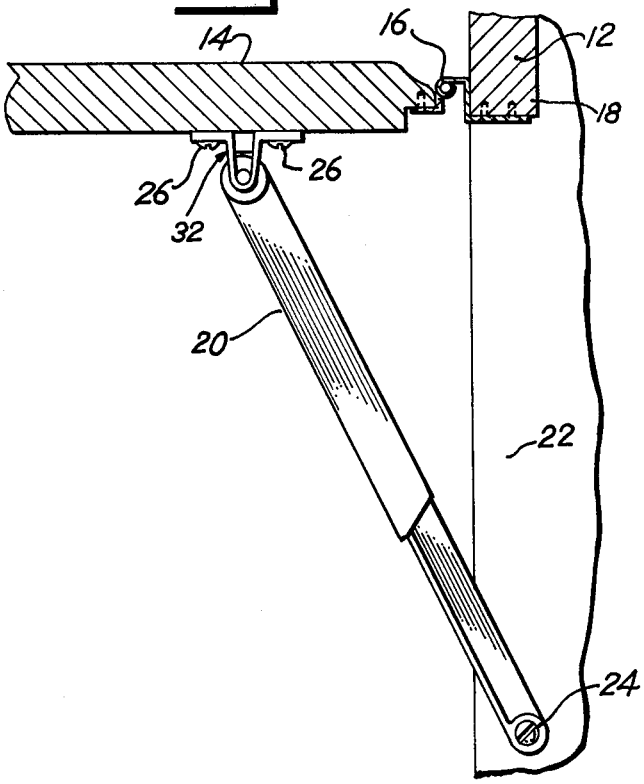
FIG. 4 is a cross-sectional view of the installed door in the open position taken along the line 4—4 in FIG. 2.
Figure 5:
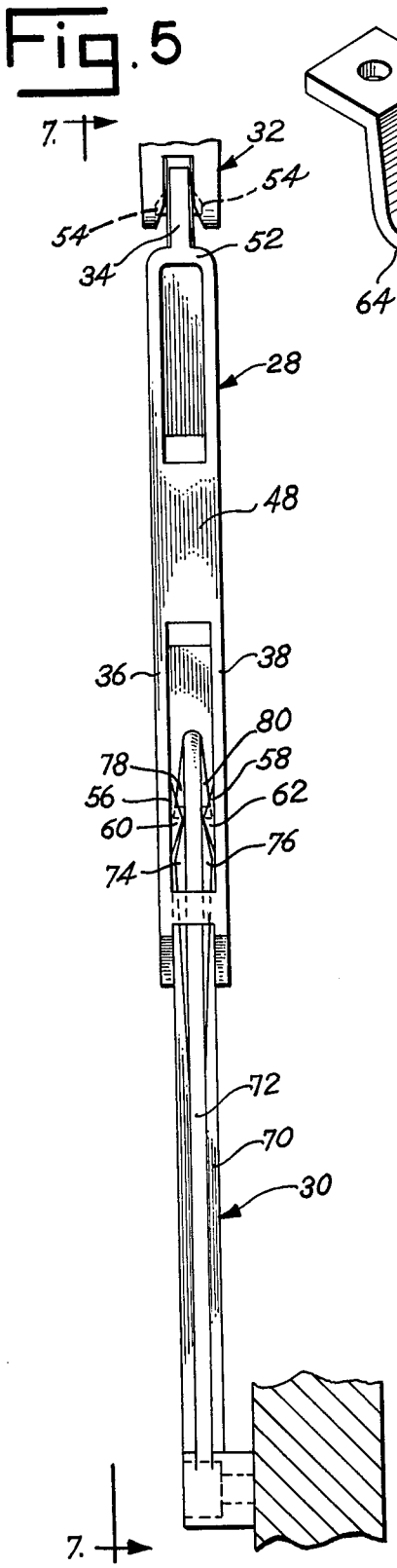
FIG. 5 is a plan view of the door support construction.
Figure 6:
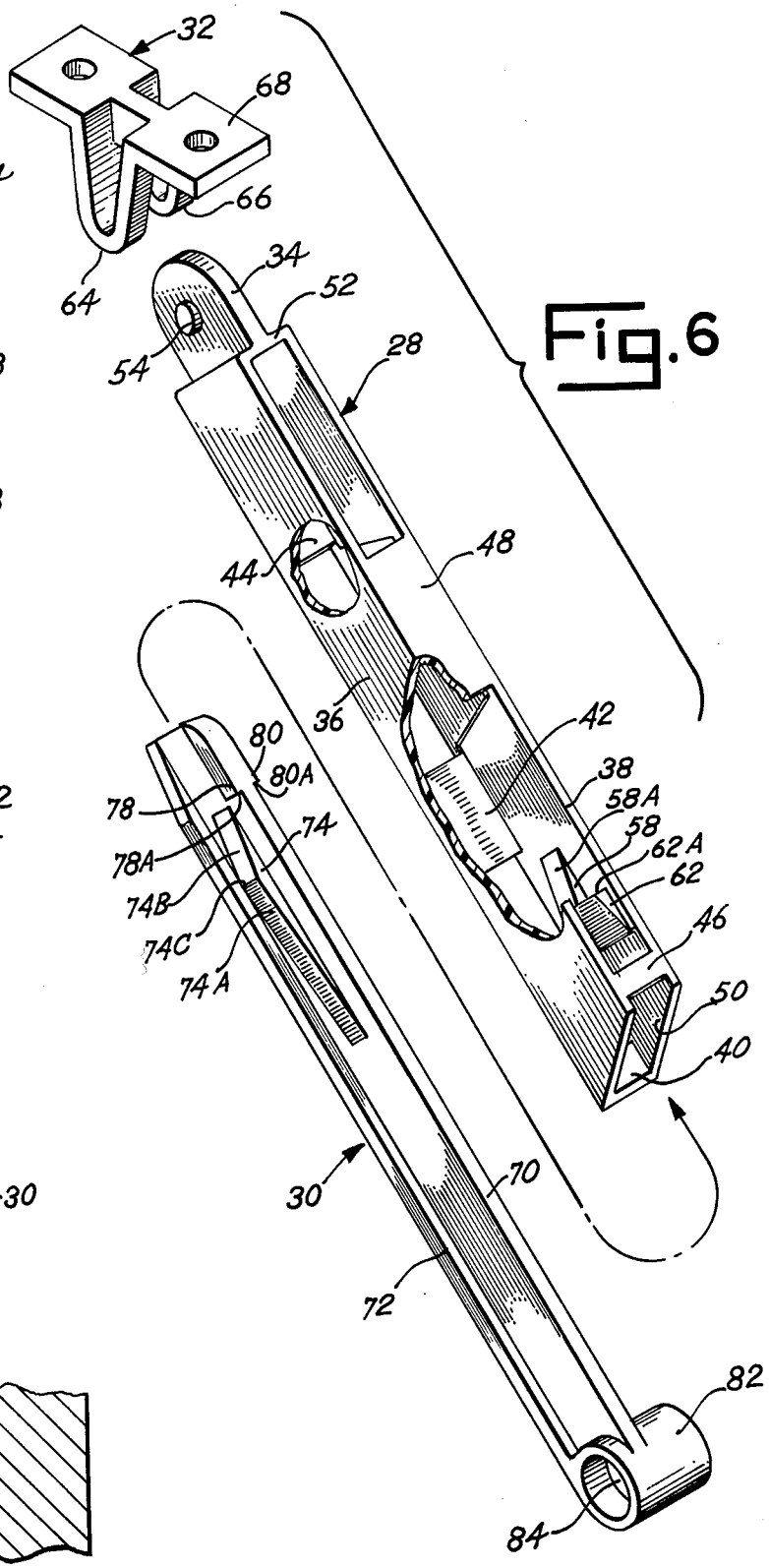
FIG. 6 is an exploded perspective view of the bracket construction illustrating the three molded plastic parts forming the device.

In FIGS. 1 through 4, a cabinet 10 includes a frame 12 defining an opening for a series of doors 14. Each door 14 is hung to pivot about a horizontal axis as shown in FIG. 3. Thus, each door 14 is hung on hinges 16 which attach between door 14 and an upper edge 18 of frame 12. Doors 14 are thus pivotal about the horizontal axis defined by hinges 16 from the substantially vertical position shown in FIG. 3 upward and outward to various positions including the horizontal position as illustrated in FIG. 4.

The invention comprises the door bracket construction 20 connected between a side frame member 22 and the inside surface of the door 14. The bracket construction 20 thus has an unextended position shown in FIG. 3 and a fully extended position illustrated in FIG. 4. The bracket construction 20 is pivotally attached to side frame member 22 by means of a screw 24 fitted through a cooperative opening identified in greater detail below. Screws 26 attach the opposite end of the bracket 20 to the inside of the door panel 14.

As shown in FIG. 2, a bracket 20 may be attached to opposite edges of the door panel 14. Alternatively, a single door bracket construction may be used attached to one edge of the door panel 14.

Referring now to FIGS. 5 through 12, the bracket construction 20 is illustrated in greater detail. Bracket construction 20 includes a housing bracket member or bracket member 28 which telescopically receives a slide member 30. A swivel bracket 32 is attached to a tongue 34 at one end of the bracket member 28. Preferably, the bracket member 28, slide member 30 and swivel bracket 32 are molded from a plastic material which has elastic properties, such as Nylon, Delrin, etc. The bracket member 28 must be made from a material which has elastic properties so that the total construction will operate in an appropriate manner. This will become apparent in the further detailed discussion below.

The bracket member 28 includes parallel opposed sides 36 and 38. The sides 36 and 38 are maintained in spaced relation by means of plate members as at 40, 42 and 44 along one side or bottom edge of the side members 36 and 38. Ribs as at 46 and 48 connect to the sides 36 and 38 along the top or opposite edge. Thus, ribs 46 and 48 are generally opposed to plate members 40, 42 and 44. The bracket members 28 is thus generally a hollow rectangular beam member with an open end 50. The end opposite the open end 50 is closed by a connecting plate 52.

Tongue 34 then projects from connecting plate 52 along the longitudinal axis of the bracket member 28. A pivot shaft 54 extends transversely from the flat tongue 34 for cooperative engagement with the swivel bracket 32.

The swivel bracket 32 includes bifurcated shaft receiving arms 64 and 66 which cooperate with the pivot shaft 54 on opposite sides of the tongue 34. An attachment plate 68 cooperates with screws 26 for attachment of the swivel bracket 32 in the manner described previously. Thus, the bracket member 28 is pivotally supported between the arms 64 and 66 and may freely pivot through approximately 180° range.

Positioned on the inside of the opposed sides 36 and 38 intermediate ribs 46 and 48 are a pair of opposed projecting cam members 56 and 58 and locking barbs 60 and 62. These will be described further below.

Slide member 30 telescopes within the open end 50 of bracket member 28. That is, slide member 30 is comprised of a longitudinal plate 70 with a flange 72 attached along the bottom edge. In cross section, the plate and flange 72 form a T-shape. The width of the flange 72 is approximately equal to the spacing of the sides 36 and 38. The width of the plate 70, however, is less than the distance between the sides 36 and 38 in order that slide member cam members 74 and 76 and barb members 78 and 80 may be formed thereon for cooperation with cam members 56 and 58 and barb members 60 and 62 respectively.

The leading edge of the flange 72 is tapered to facilitate entry of the slide member 30 through the open end 50 into the bracket member 28. The opposite end of the slide member 30 includes an integrally molded pivot cylinder 82. That is, the cylinder 82 is molded integrally at the end of the slide member 30 and includes a center passage 84 for receipt of screw 24 previously described.

The slide member telescopically fits between the sides 36 and 38 of the bracket member 28. The plates 40, 42 and 44 form a support surface for the lower flange 72. The cam members 56 and 58 are spaced upwardly from the plane of the plates 40, 42 and 44 a sufficient distance to permit the flange to slide relative to the sides 36 and 38. This arrangement also serves to correctly position the slide member and confine it to a single degree of freedom or motion within the bracket member 28.

The cam members 56 and 58 are on a longitudinal line of interference with associated respective cam members 74 and 76 of slide member 30. That is, the cam members 56, 58 will engage members 74, 76 as the slide member 30 moves with respect to bracket housing 28. Each cam member 56, 58, 74 and 76 has substantially the same surface shape. In other words, each cam member, for example, cam member 74 includes inclined surfaces 74A and 74B which meet at a line of intersection 74C. A cross section of the cam surface 74 is V-shaped and defines an obtuse angle included by surfaces 74A and 74B.

In a similar fashion, the barbs 60 and 62 of housing bracket 28 are positioned to cooperate or intersect with barbs 78 and 80 of sliding member 30. Barbs 60, 62, 78 and 80 are in a plane distinct from the plane of cam members 56, 58, 74 and 76. The edge 60A and 62A of barbs 60 and 62, respectively, are above and coincides with an extension of the line of intersection of the planes 56A, 56B and 58A, 58B which form cam member 56 and 58A, respectively.

Barbs 78 and 80 are defined by edge surfaces 78A and 80A which coincide substantially with the extension of the line of intersection of cam surface 74B with plate 70 and 76B with plate 70.

Figure 7:
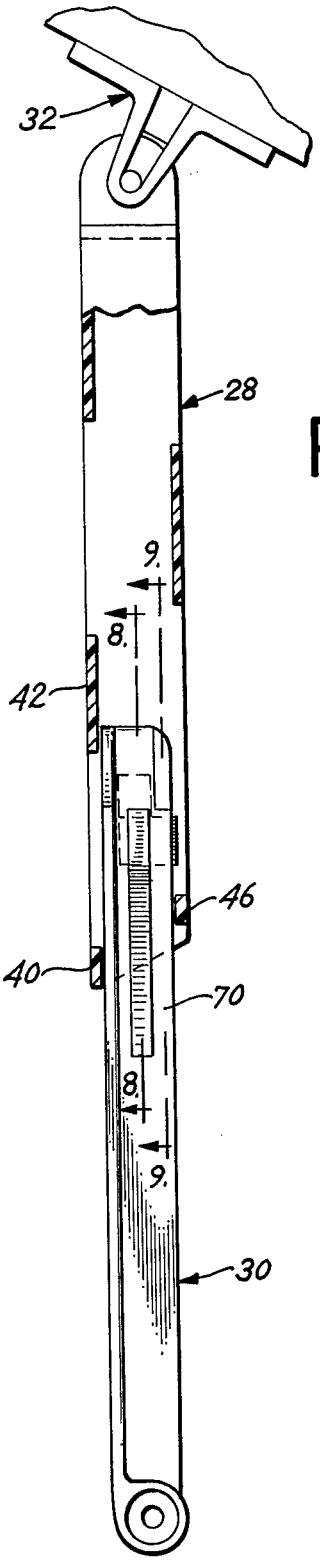
FIG. 7 is a side view of the device taken along the line 7—7 in FIG. 5.
Figure 10:
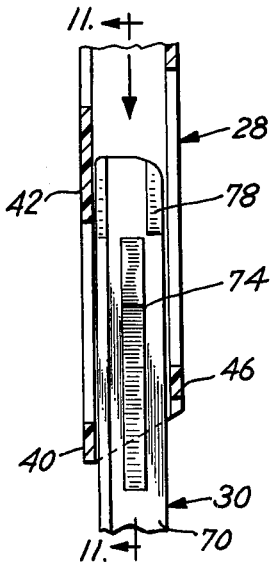
FIG. 10 is a side cross-sectional view of the door support construction as it is being manually moved toward the closed position.
Figure 8:
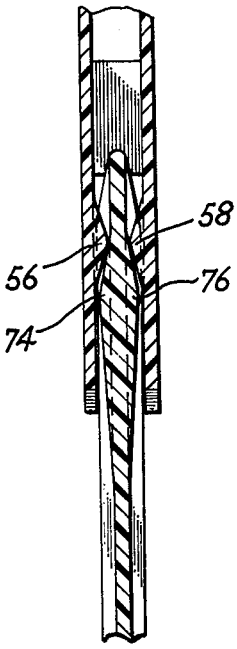
FIG. 8 is a cross-sectional view of the camming mechanism for the door construction taken along the line 8—8 in FIG. 7.
Figure 9:
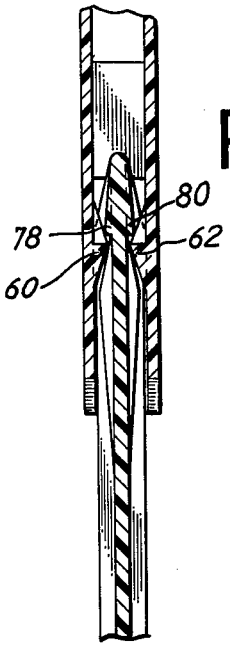
FIG. 9 is another cross-sectional view of the camming mechanism shown in FIG. 7 taken along the line 9—9.

In operation, when the slide member 30 is moved to the fully telescoped or open position within the bracket member 28 as shown in FIG. 7, the barbs or barb members 78 and 80 interfere respectively with the locking barbs 60 and 62 as shown in FIG. 9. This limits further travel of slide members 30 since the barbs are dimensioned to engage one another in the manner illustrated in FIG. 5 and FIG. 9. Barbs 78, 80, 60, 62 limit further extension of the bracket construction 20 and cam members 56, 58, 74 and 76 interfere as shown in FIG. 8 to hold the bracket construction in extended position.

Figure 11:
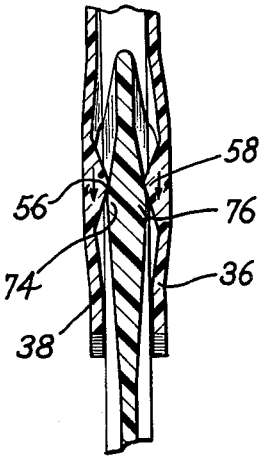
FIG. 11 is a cross-sectional view of the opposed camming surfaces taken along the lines 11—11 in FIG. 10.

To move the bracket member 20 from the fully extended position of FIGS. 7–9 to the closed position, it is necessary to force the cam members 74 and 76 against and over the cam members 56 and 58 as shown in FIG. 11. That is, the cam members 56, 58, 74 and 76 are dimensioned so as to equal a distance greater than the normal separation of walls 36 and 38. In order to telescopically fit or insert the slide member 30 fully within the bracket member 28 then, it is necessary to spread the side walls 36 and 38. This spreading results because the sides 36 and 38 are formed of elastic material. Moreover, ribs 46 and 48 and plates 40, 42 and 44 are positioned longitudinally away from the point of maximum interference between cam members 74, 76, 56 and 58.

Figure 12:
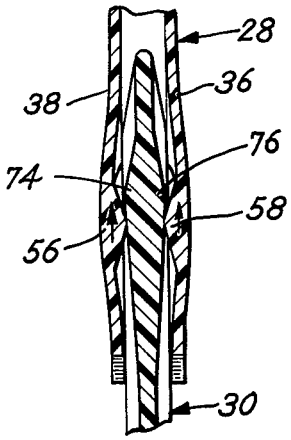
FIG. 12 is a cross-sectional view similar to that of FIG. 11 illustrating the further progress of the cam members during closing of the door and associated bracket member.

Forcing the cams 74, 76 and 56, 58 together allows for longitudinal travel of the slide member 30 within bracket housing 28 from the position of FIG. 11 to the position of FIG. 12. The slide member 30 then slides easily into the bracket member 28.

The amount of weight that is supported or the force that is required to telescope the bracket construction 20 is dependent upon the dimension of the cam members 56, 58, 74 and 76 and the modulus of elasticity of material forming the bracket member 28. Thus, it can be seen that the operation of the bracket 20 is dependent upon the elastic properties of the bracket member 28. The sliding member 30 need not be formed of an elastic material and, in fact, may be formed of a material that is substantially inelastic.

While in the foregoing there has been set forth a preferred embodiment of the invention, it is to be understood that the invention shall be limited only by the following claims and their equivalents.

What is claimed is:

1. A door support bracket construction to maintain a door hung about a horizontal axis on a frame in an open position comprising, in combination:

a bracket member comprised of an elastic material, said bracket member including opposed, spaced sides, said bracket member also including a guide plate connecting the sides and maintaining the sides in a substantially constant spaced relation; and a slide member telescoped at one end into an end of the bracket member between the sides, the opposite end of each member including means for pivotally attaching that member to the frame or door;

the inside surface of said bracket sides and the outside surface of the slide member including opposed cam surfaces inclined toward each other to define a single position of maximum interference which elastically separates the sides upon sliding movement of the slide member relative to the bracket member at a position slightly less than full extension of the slide member in the bracket member, said inside surface of the bracket member and the outside surface of the slide member also including separate opposed locking barbs which engage at full extension of the slide member in the bracket member to limit further telescoping action, said sides being normally separated at full extension whereby the opposed cam surfaces engage and prevent said slide member from telescoping into the bracket member until sufficient force is provided to elastically separate the bracket sides.

2. The improved construction of claim 1 wherein said bracket member includes a longitudinal slot and said slide member includes a projecting flange maintained in said slot whereby said slide member is guided in longitudinal telescoped relation with the bracket member and maintained in said bracket member.

3. The improved construction of claim 1 wherein said opposed cam surfaces are of V-shaped cross section in opposed relation, each cam surface having an included obtuse angle.

4. The improved construction of claim 1 wherein said bracket member has a rectangular cross section perpendicular to the longitudinal axis thereof with the sides formed by opposed parallel walls and including connecting ribs for maintaining the sides in spaced relation.

5. The improved construction of claim 4 wherein said ribs on one side of said member are longitudinally spaced from the opposed cam surfaces projecting inwardly from the sides, whereby said sides of said member are permitted to elastically deform upon interference between the cam surfaces of the slide member and bracket member.

6. The improved construction of claim 2 wherein said flange is defined along the lower edge of said slide member and wherein said slot is defined at least in part by the opposed cam surfaces of the bracket member.

7. A door support bracket construction to maintain a door hung about a horizontal axis on a frame in an open position comprising, in combination:

a bracket member comprised of an elastic material, said bracket member including opposed, spaced sides, said bracket member also including a guide plate connecting the sides and maintaining the sides in a substantially constant spaced relation and a longitudinal slot; and a slide member telescoped at one end into an end of the bracket member between the sides, the opposite end of each member including means for pivotally attaching that member to the frame or door, said slide member including a projecting flange extending into the longitudinal slot to guide the slide member in the bracket member;

the inside surface of said bracket sides and the outside surface of the slide member including opposed cam surfaces inclined toward each other to define a single position of maximum interference which elastically separates the sides upon sliding movement of the slide member relative to the bracket member at a position slightly less than full extension of the slide member in the bracket member, said inside surface of the bracket member and the outside surface of the slide member also including opposed locking barbs which engage at full extension of the slide member in the bracket member to limit further telescoping action, said sides being normally separated at full extension whereby the opposed cam surfaces engage and prevent said slide member from telescoping into the bracket member until sufficient force is provided to elastically separate the bracket sides.

8. A door support bracket construction to maintain a door hung about a horizontal axis on a frame in an open position comprising, in combination:

a bracket member having a longitudinal axis and comprised of an elastic material, said bracket member including opposed, spaced sides forming a generally rectangular cross section perpendicular to the longitudinal axis, said bracket member also including a guide plate and connecting ribs connecting the sides and maintaining the sides in a substantially constant spaced relation; and a slide member telescoped at one end into an end of the bracket member between the sides, the opposite end of each member including means for pivotally attaching that member to the frame or door;

the inside surface of said bracket sides and the outside surface of the slide member including opposed cam surfaces inclined toward each other to define a single position of maximum interference which elastically separates the sides upon sliding movement of the slide member relative to the bracket member at a position slightly less than full extension of the slide member in the bracket member, said inside surface of the bracket member and the outside surface of the slide member also including opposed locking barbs which engage at full extension of the slide member in the bracket member to limit further telescoping action, said sides being normally separated at full extension whereby the opposed cam surfaces engage and prevent said slide member from telescoping into the bracket member until sufficient force is provided to elastically separate the bracket sides.

* * * * *